United States Patent [19]

Stoakes

[11] 4,031,680

[45] June 28, 1977

[54] STRUCTURAL ASSEMBLIES

[76] Inventor: Richard Lewis Stoakes, "Clouds" Northdown Road, Woldingham, Surrey, England

[22] Filed: May 20, 1975

[21] Appl. No.: 579,214

[30] Foreign Application Priority Data

May 29, 1974 United Kingdom ..... 23832/74

[52] U.S. Cl. ..... 52/400; 52/468; 52/475; 52/499

[51] Int. Cl.[2] ..... E04B 1/62

[58] Field of Search ..... 52/235, 475, 397, 400, 52/494, 499, 464, 393, 468, 403, 476

[56] References Cited

UNITED STATES PATENTS

| | | | |
|---|---|---|---|
| 2,845,154 | 7/1958 | Duffield | 52/464 X |
| 3,344,573 | 10/1967 | Martin et al. | 52/400 X |
| 3,514,916 | 6/1970 | Hoverman, Jr. | 52/400 |
| 3,766,698 | 10/1973 | Dallen | 52/400 |
| 3,858,375 | 1/1975 | Silvernail | 52/235 |

FOREIGN PATENTS OR APPLICATIONS

| | | | |
|---|---|---|---|
| 1,407,459 | 9/1974 | France | 52/400 |

*Primary Examiner*—Price C. Faw, Jr.
*Assistant Examiner*—Carl D. Friedman
*Attorney, Agent, or Firm*—Hopgood, Calimafde, Kalil, Blaustein & Lieberman

[57] ABSTRACT

A structural assembly comprises a frame structure and infill panes or panels retained in the frame structure with weathertight seals at their peripheral edges and at marginal portions of their inner faces adjacent to said edges. Clamping means engaging the outer faces of the panes or panels apply sealing pressure for said marginal portions but are not relied on to provide seals. In a preferred construction the sealing means are substantially flush with the outer faces of the panes or panels and the clamping means comprise a series of small and widely spaced devices that bridge contiguous panes or panels.

11 Claims, 3 Drawing Figures

STRUCTURAL ASSEMBLIES

BACKGROUND OF THE INVENTION

This invention relates to structural assemblies for building or other architectural constructions and is particularly concerned with such assemblies erected to form an enclosing wall or surface, whether planar or not, said wall or surface comprising a frame structure defining a plurality of cells and having an infill of panes (i.e. transparent or translucent sheets) and/or panels mounted in the cells.

Structural assemblies of this kind may be used for such purposes as curtain walls, i.e. external walls of a building that are not required to support the building, or for internal partitions, the infill panes or panels being used to give an aesthetically pleasing appearance. Although not load-bearing, these structures must be made in such a way as to be weathertight, in particular resisting the entry of wind-driven rain. Thus, substantial glazing bars extend round the edges of the panes or panels to hold sealing gaskets firmly against the panes or panels, these bars being a prominent feature of the exterior of the structure and thereby dictating to a considerable extent the appearance of the structure. It is possible, of course, to use larger area panes or panels to reduce the visual impact of the glazing bars but this also limits the decorative effects that may be obtained as well as making the structure more difficult to erect because of the cumbersome and often fragile nature of the panes or panels.

It is an object of the present invention to provide a form of structural assembly of the kind referred to in which large external glazing bars are not necessary, whereby the external appearance of the structure need not be dictated by the presence of such bars, while avoiding the need for extremely large panes or panels, yet nevertheless providing means for weather-tightness at the junctions between adjacent panes or panels.

SUMMARY OF THE INVENTION

According to the invention, a structural assembly is provided comprising a frame structure formed by interconnected elongate members having means for mounting infill panes or panels on or adjacent an outer face of said structure with sealing means engaging the panes or panels both at their edges and at portions of their inner faces adjacent said edges, securing means engaging the outer faces of the panel or panes adjacent their edges to apply sealing pressure between the sealing means and said portions of the inner faces.

In such an arrangement, the securing means does not apply pressure directly to the sealing means but rather urges the panes or panels against the sealing means at their rear or inner faces. In front of this main seal there is an auxiliary water-resistant seal provided by the engagement with the edges of the panes or panels. In this manner, it is possible to avoid the need to have glazing bars of substantial width overlapping the edges of the panes or panels along their full extent and, indeed, in a preferred form of the invention the securing means comprises a series of relatively small devices disposed at intervals along the edges of the panes or panels and individually fixed in position, so that externally there need only be a few widely spaced and unobtrusive securing devices which may be hardly visible at all except on close inspection.

Preferably, at least some of the securing devices comprise clamping elements each connected to the main structure by at least one fastening element, said clamping and fastening elements being covered by a protective capping that advantageously is of a resilient material. A portion of the capping or another resilient member may be disposed between the clamping element and the pane or panel secured thereby, to transmit the pressure from the clamping element.

In a structure according to the invention, the sealing means may have a front face substantially co-planar with the front or outer faces of the panes or panels so as to form a substantially flush front surface to the structure. In a convenient arrangement the sealing at contiguous edges of the panes or panels of adjacent cells of the structure are provided by respective gaskets that have opposed edges spaced apart and a further sealing member is mounted between them to form a seal between said edges and itself has a front face substantially co-planar with the adjacent front faces of the gaskets.

In a preferred form of the invention, the sealing members are carried by mounting members that extend into the vertical plane of the panes or panels so as to transmit their weight to the main frame members. Such mounting members may themselves be separate from and slidably attached to the main frame members. Where such separate mounting members are employed, it may be desirable to seal the junctions between them and the main frame members and, advantageously, this is done by using further sealing means that are integral part of the main sealing gaskets for the panes or panels.

To assist the assembly of the structure, it may be arranged that spaced retaining elements are provided to locate the sealing gaskets adjacent the edge and inner sealing regions respectively during the initial assembly of the sealing gaskets in order to hold the gaskets in place on the structure. Subsequently, said further sealing member between the opposed edges of an adjacent pair of sealing gaskets may be employed to lock them firmly into place.

The main seal between the peripheral inner face regions of the panes or panels and the sealing gaskets is obtained by the pressure applied by the securing means but said means will not ensure an adequate seal at the edges of the panes or panels, where the bearing faces are transverse to said inner face sealing faces. It is therefore preferably arranged that the sealing engagement there is provided by a re-entrant limb that is a freely extending element of a J-form portion of the main gasket whereby said limb can be deflected substantially from its unstrained condition when engaged by the pane or panel.

BRIEF DESCRIPTION OF THE DRAWINGS

The invention will be more particularly described with reference to the accompanying drawings, wherein.

DESCRIPTION OF THE PREFERRED EMBODIMENT

Figure 1:
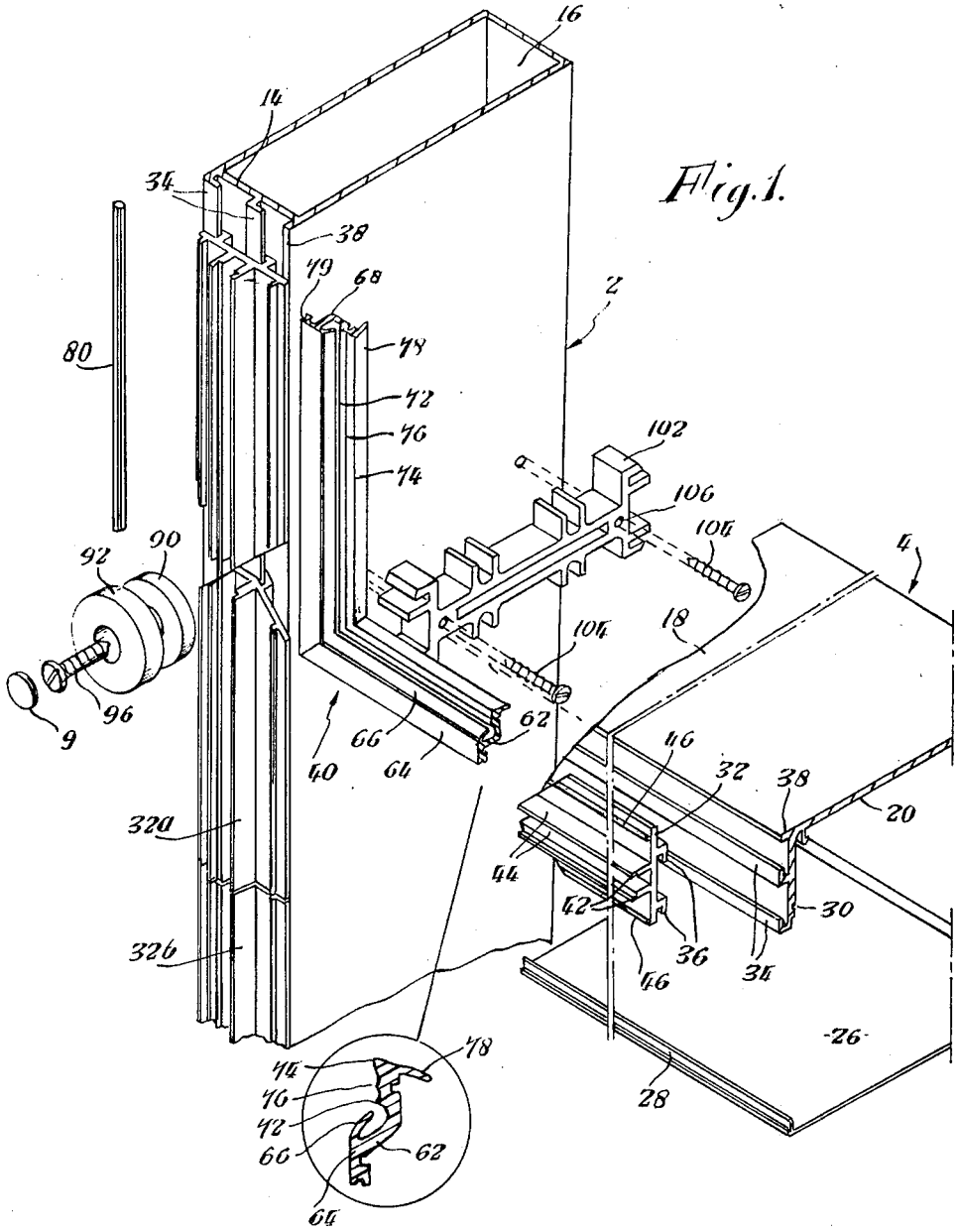
FIG. 1 is an exploded perspective view of part of a structural assembly according to the invention, the infill panes or panels being omitted for clarity.
Figure 2:
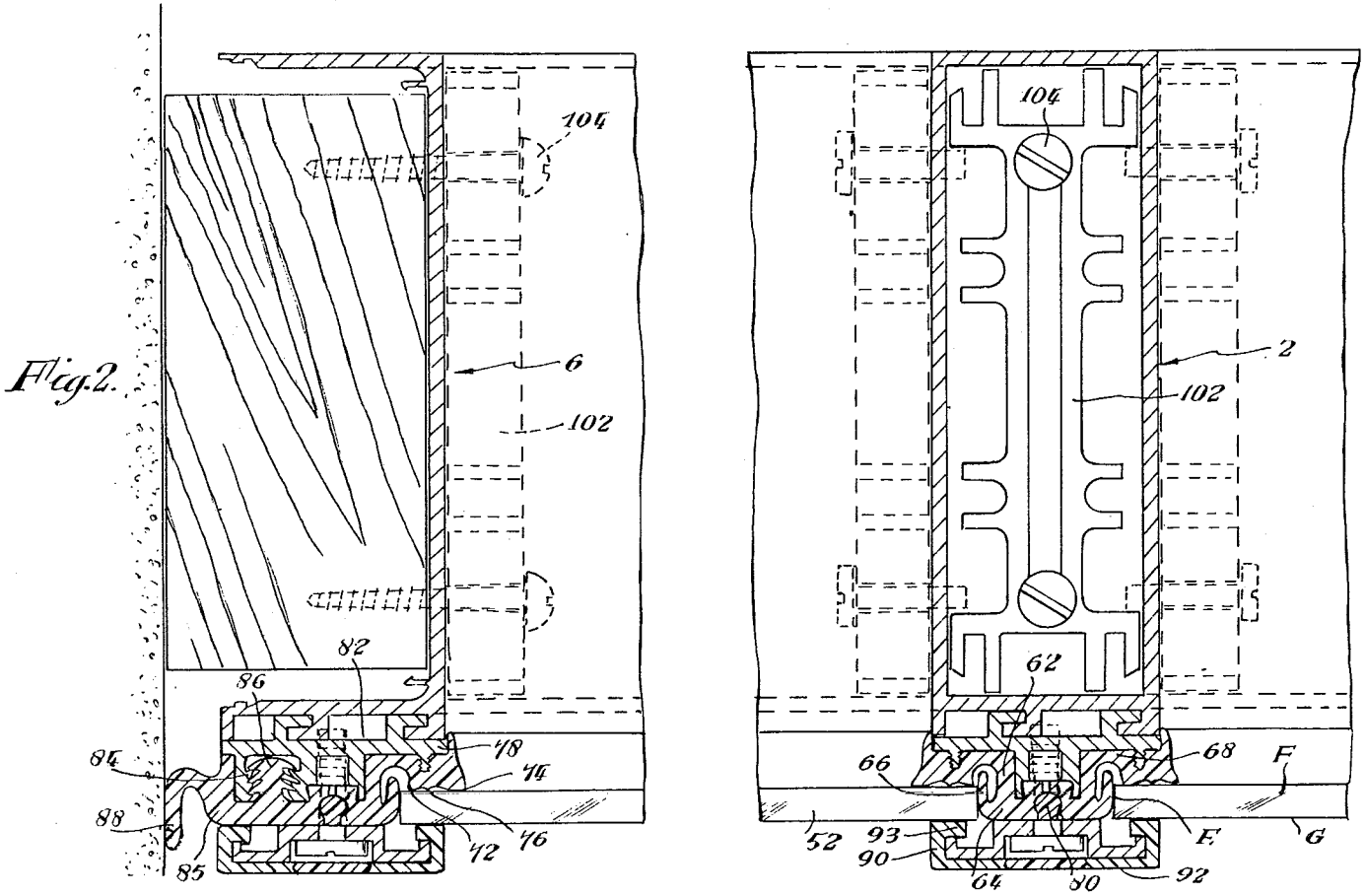
FIG. 2 is a sectional elevation in a horizontal plane through mullion and jamb mullion members of the structural assembly of FIG. 1, and, FIG. 3 is a section in a vertical plane through a transom member of the structural assembly of FIG. 1.

Referring to the drawings, the structural assembly comprises a main frame of extruded members including at least one mullion member 2 with transom members 4 connected to opposite sides of it, the mullion and transom members thus dividing the area of the frame into a series of cells. Jamb mullion members 6 and top and bottom cill members form the edges of the frame. The cill members are not illustrated but as they have the same cross-section as the jamb mullion members and are used in an entirely analogous way to the jamb mullion members further illustration and description is not necessary.

The or each mullion member has a box-form cross-section comprising side walls 12 and front and rear webs 14, 16. Each transom member is made up of a channel-form cross-section main extrusion 18 having a main side wall 20 and front and rear webs 22, 24, while a cover plate 26 closes the open side of the channel and is secured to the main extension by snap-fitting ribs and recesses 28, 30. The jamb mullion members and top and bottom cill members employ further lengths of the extrusions 18 but unlike the transom members these are not provided with cover plates.

To mount sealing means on the front face of the frame, the front webs of the respective main frame members are provided with attachment elements 34 for mounting bars 32. Said attachment elements are of angle or hook form and co-operate with similar oppositely facing attachment elements 36 on the mounting bars. One of the elements 34 forms a forward projection of the adjacent side edge on its main frame member and a rib 38 is provided on the opposite edge of the front wall as a forward projection of the other side edge of the member. The arrangement is such that opposite side edges of each mounting bar abut edge portions of the associated frame member povided by said forward projections, as may be most clearly seen in the sectional views in the drawings.

The sealing means comprise extruded main gaskets 40 of neoprene retained on the bars 32 by means of wedge-form ribs 42 on front flanges 44 of the bars and interlocking serrated-section ribs 46 on the front faces of the bars, both ribs fitting in complementary recesses in the gaskets. The gaskets 40 provide seatings for panes or panels 52 that form an infill for the cells of the frame over the front face of the frame. The gaskets are arranged to have sealing engagement both with the edges E of the panes or panels and with the portions of the rear or inner faces F of the panes or panels immediately adjacent said edges.

For said edge engagement the gasket cross-section comprises a forwardly projecting web 62 carrying a front flange 64 one edge of which has a rearwardly projecting sealing lip 66 that in the unrestrained state shown in FIG. 1 is inclined away from the web 62, the portions 62, 64, 66 having substantially a J-form. For said rear or inner face engagement, a side flange 68 of the gasket extends laterally from the rear of the web 62 and has a front sealing face with a sectional shape comprising a series of three projections. Of these projections, an inner lobe 72 provides a forwardly projecting shoulder adjacent but laterally outwardly of the lip 66. An outer lobe 74 forms the laterally outer edge of the flange and in the unrestrained state of the gasket, as shown in FIG. 1, projects forwards slightly beyond the lobe 72. Between these two lobes and approximately coincident laterally with the recess for the rib 46, is the third projection in the form of an auxiliary ridge 76 shallower than either of the lobes.

At the laterally outer extremity of the flange 68 there is a rearwardly directed lip 78 that extends over the junction between the associated mounting bar and its associated frame member. In addition, the front flange 64 of the gasket has a profiled laterally inner edge 79 adapted to the shape of a locking or zipper strip 80 of material that is hard in relation to the material of the gaskets 40 but is also elastically deformable, the zipper strip being inserted on assembly between a pair of opposed gaskets, as may be seen in the sectional views, to apply a compression force to the gaskets holding them more firmly onto the ribs 42 of the mounting bars and to form a seal between the opposed gaskets.

At the edges of the frame, a modified form of mounting bar 82 is provided that differs from the bars 32 in that, to one side of the forwardly projecting ribs, a channel 84 is provided to retain an edge gasket 85 in place, the opposed faces of the channel having a ridged cross-section to grip complementary ridges on a rearwardly projecting web 86 of the edge gasket. It will also be seen that, to provide sealing engagement with a jamb or cill surface of an aperture in which the frame fits, the edge gasket has a flexible laterally projecting limb 88 that bears on said surface.

To hold the panes or panels in place and to provide a clamping force to ensure sealing engagement with the above-described projections on the side flanges of the gaskets, clamping discs 90 are secured at intervals to the frame members to bear on the front faces G of the panes or panels, the screws being driven through the zipper strips between adjacent lengths of gasket. A compression washer (not shown) can be placed behind each disc 90 to spread the clamping pressure on the panes or panels but as illustrated, a neoprene cover 92 giving weather protection to its disc 90 also has a rear peripheral lip 93 that provides a resilient pad transmitting the clamping pressure from the disc. A central aperture in the cover gives access to a clamping screw 96 and is closed by a press-fitted button 94 when the screw has been driven home.

To erect the structural assembly, the frame members and the mounting bars can be pre-cut to the required lengths and the frame members are assembled in place first, with the lower cill member being secured initially to the bottom surface of the aperture in which the frame sits and the jamb mullion members to the side surfaces, using packing pieces in a conventional manner. The mullion members, including the jamb mullion members, are located on the lower cill member by spigot members 102 formed by short lengths of extruded metal section and secured to the cill member by screws 104 passing through apertures 106. The mullions and jamb mullions extend to the top edge of the frame where further spigot members engage respective members of the upper cill running between adjacent pairs of these vertical frame members.

Spigot members 102 screwed to the mullion and jamb mullion members are also used to mount the transom members to the mullion members, after which the bottom cover plates are snapped into place on the transom members. A feature of the assembly is the manner in which relative movement can take place between interconnected frame members to allow for differential thermal expansion, for example, to take place: thus, the transom members are not restrained from sliding on the spigots 102 and will be of a length such that when assembled initially there is a slight clearance with the mullion members between which they extend.

The mounting bars are next assembled in place. For each side of a cell in the frame, short mitred lengths (exemplified at 32*a* in FIG. 1) of the mounting bars are hooked onto the attachment elements 34 and slid into place at the ends of the side, i.e. at a junction between frame members, and then a length of mounting bar (32*b* in FIG. 1) is hooked into place on each cell side to substantially fill the gap between the mitered lengths at opposite ends of the side. At the top cill members, where the attachment elements 34 will be directed downwards, the bars 32 may be secured by screws if needed.

The gaskets 40, which will have been preformed as closed loops by bonding lengths of the gasket section together at mitered junctions, are next put in place. The ribs 42, 46 retain them in position initially and they are then fully secured by insertion of the zipper strips 80. The panes or panels can now be inserted, conveniently working upwards from the bottom cells of the frame, and initially some of the clamping discs are screwed in on one or two sides of each cell, but are not tightened down fully, to retain a pane or panel for that cell in place before it is secured on all sides.

In most instances it will be sufficient for the clamping screws 96 to engage the front flanges 44 of the mounting bars 32 but they can alternatively be of a length to penetrate the main web of a mounting bar, as shown at 96*a*, or even to engage the front web of the frame member behind the mounting bar. This last arrangement would be necessary, for example, at the junction between frame members where, as indicated in FIG. 1, the mitered ends of the clamping bars meet and cannot offer a secure engagement for a screw, the mitres then conveniently being truncated to give a clear passage for the clamping screw to the mullion front web. If however, in place of the mitered lengths 32*a* a casting or moulding (not shown) is provided at a junction region and is of a form that integrally incorporates the respective arms projecting along the adjacent regions of the frame members forming the junction, the clamping screw 96 can be secured to this instead of extending into the frame members.

It will be normally desirable to provide weep holes (not shown) in the lip 66 at the bottom of a cell for the drainage of condensation. The rear sealing means will prevent seepage of this condensation inwardly of the frame.

As each pane or panel is positioned in its cell of the frame, it will engage the lips 66 of the adjacent side flanges 64 of the gasket and the lips 66 will be pressed against the edges of pane or panel by their own resilience, which is enhanced by the manner in which they extend freely from the flanges 64. This provides an outer weather-seal that is additional to the primary multiple line seal between the projections 72, 74, 76 of the flanges 68 and the inner faces of the pane or panel adjacent its edge, the clamping discs 90 applying the pressure that makes that latter seal. It will be seen that the frame members and the mounting bars are all located inwardly of these two seals so that gaps and clearances between these elements of the frame do not affect the weather-tightness of the assembly. As a further precaution however, the rearwardly directed lip 78 of the gasket covers the line of abutment between the adjacent side edge of the mounting bars and the front of the frame members, the unrestrained form of the lip 78 ensuring that it is flexed into engagement with the frame at said line of abutment.

It may be noted that the front flanges 44 of the mounting bars extend into the plane of the panes or panels so that their weight is transmitted directly to the horizontal main frame members by the mounting bars, the gaskets being subjected wholly or mainly to a compression force and thus relatively minor deformation.

A feature of the construction as described is the relatively unobstructed appearance of the front face of the assembly. As may be seen in the sectional views, the sealing gaskets can lie substantially flush with the outer face of the panes or panels and need in any case be so narrow in relation to the dimensions of individual panes or panels so as to be relatively inconspicuous. The clamping discs can also be small and so widely spaced as to have no noticeable effect on the external appearance of the assembly — of course, the shape of the discs can be varied as desired provided they are capable of applying the required clamping pressure and the use of clamping means of substantially continuous strip form is not precluded. The frame members and mounting bars will be completely hidden by opaque infill panels and will also not be apparent from most aspects when covered by glass panes. At the same time, sealing is not required on the front face of the assembly and this can be given a wide range of finishes, many of which would otherwise be impractical, for decorative or other purposes.

Figure 3:
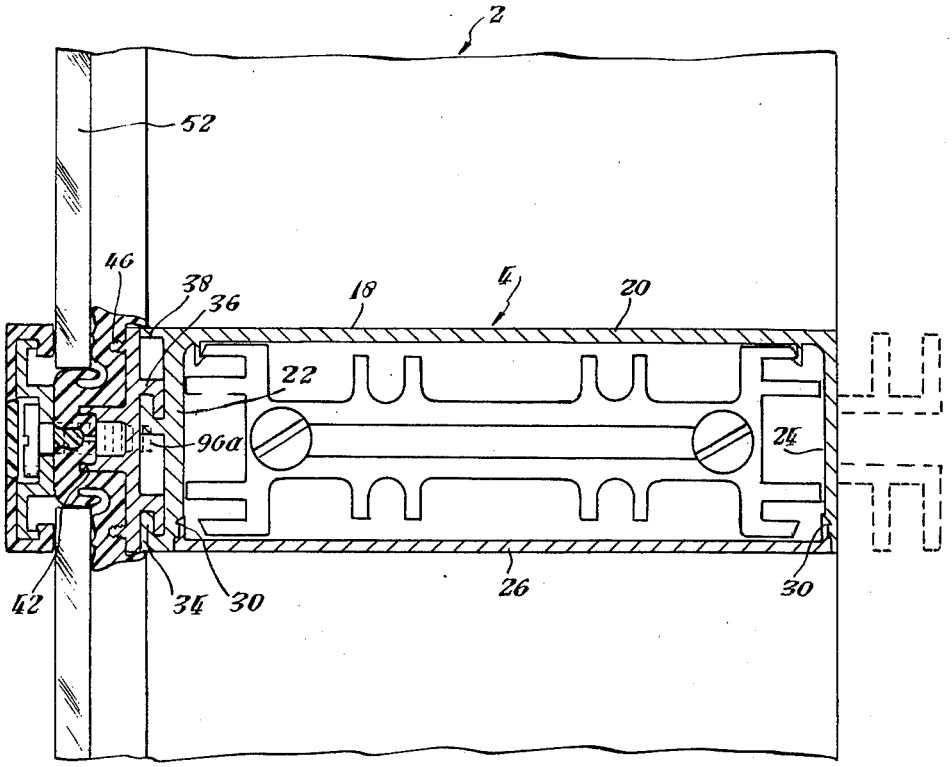

If a two layer or sandwich infill is required, e.g. as double glazing, this can conveniently be provided at or adjacent the rear webs of the main frame members. For example, as indicated in broken lines in FIG. 3, pairs of channels may be provided as rearward extensions of each member, with the channel surfaces running parallel to the rear web and two pairs of such channels opening in opposite directions. This allows the second infill layer to be formed by pairs of sliding panes or panels for each cell, whereby access can be obtained to the inside face of the outer layer for cleaning.

It will be appreciated that the invention can take other forms than that illustrated. For example, although the drawings show a planar assembly, the invention is also applicable to curved or multi-planar assembly. Also, while rectangular frame cells have been described, these, and indeed the assembly itself, may have other forms. Nor is there any specific limitation as regards the nature of the infill panes or panels that can be employed in an assembly according to the invention and opening window lights or other ventilation means can be included, for example, and illuminated panels. As a final example, while the foregoing description is of an embodiment in which the main gaskets provide both seals at the edges and at the peripheral inner faces, it will be understood that separate gasket members can be employed to provide these respective seals.

What I claim and desire to secure by Letters Patent is:

1. A structural assembly comprising, in combination, a series of interconnected elongate members, a frame structure formed by said interconnected members, at least two contiguous cells or spaces being defined in said structure by said members, panes or panels mounted on or adjacent an outer face of said structure and providing infill members for said cells or spaces, sealing means engaging the infill members both at edges thereof and at portions of inner faces thereof adjacent said edges, said sealing means having a front face substantially coplanar with the outer faces of the infill members, and being contoured, at portions thereof engaging said edges of the infill members, to provide local resilient deformability, securing means engaging outer faces of the infill members adjacent said edges to apply a sealing pressure between the sealing means and said portions of the inner faces, said securing means comprising a series of devices that are disposed at intervals along the edges of the infill members, and means fixing said devices individually in position on the frame structure.

2. A structural assembly according to claim 1 wherein at least some of said devices comprise clamping elements each fixed to the frame structure by at least one fastening element, a respective capping covering said clamping and fastening elements of each said device.

3. A structural assembly according to claim 2 wherein said cappings are resilient and have portions that are disposed between the clamping elements and the panes or panels and that transmit the clamping pressure therebetween.

4. A structural assembly according to claim 1 wherein the sealing means at contiguous edges of the infill members of adjacent cells of the frame structure is provided by respective sealing gaskets that have opposed edges spaced apart, and a further sealing member is inserted between said respective gaskets to form a seal between said edges, a front face of said further sealing member being substantially co-planar with adjacent outer front faces of the gaskets.

5. A structural assembly according to claim 1 further comprising mounting members supported on said interconnected members, the sealing means attaching the infill members to said mounting members and said mounting members extending into the vertical plane of the infill members so as to transmit the weight of the infill members to said interconnected members.

6. A structural assembly according to claim 1 further comprising mounting members separate from and slidably attached to the main members of the frame structure, the sealing means comprising gaskets attached to said mounting members.

7. A structural assembly according to claim 6 comprising further sealing means that extend across the junctions between the mounting members and the main frame members to seal said junctions.

8. A structural assembly according to claim 7 wherein said further sealing means are an integral part of said sealing means for the edges and said inner face portions of the infill members.

9. A structural assembly according to claim 1 wherein the sealing means comprise strip-form gaskets having respective integral portions for said edge and inner face portion seals and means locating said gaskets on the frame structure comprise spaced retaining elements adjacent the edge and inner sealing regions respectively.

10. A structural assembly according to claim 1 wherein said edge engagements of the sealing means are provided by gaskets having a cross-sectional form comprising a J-form portion that includes a rearwardly directed and freely extending limb having a side face bearing resiliently against said edges of the infill members whereby said limb is resiliently deformed to produce a pressure force acting on its associated infill member generally in the plane of the infill member.

11. A structural assembly comprising, in combination, a series of interconnected elongate main members, a frame structure formed by said interconnected members, at least two contiguous cells or spaces being defined in said structure by said members, said frame structure further including mounting members extending along but separate from said main members and slidably supported on said main members, sealing gaskets supported on said mounting members, panes or panels located at or adjacent an outer face of said structure with outer faces substantially co-planar with front faces of the sealing gaskets and providing infill members for said cells or spaces, said infill members being sealingly engaged by said sealiing gaskets both at edges of the infill members and at portions of inner faces thereof adjacent said edges, said gaskets being contoured, at portions thereof engaging said edges of the infill members, to provide local resilient deformability, said mounting members extending into the vertical plane of the infill members so as to transmit the weight of the infill members to said frame structure main members, securing means engaging outer faces of the infill members adjacent said edges to apply a sealing pressure between the sealing gaskets and said portions of the inner faces, said securing means comprising a series of discrete devices that are disposed at intervals along the edges of the infill members, and means fixing said devices individually in position on the frame structure.

* * * * *